US005738162A

United States Patent [19]

Crafton

[11] Patent Number: 5,738,162

[45] Date of Patent: Apr. 14, 1998

[54] TERRACED FLUIDIZED BED

[75] Inventor: Scott P. Crafton, Marietta, Ga.

[73] Assignee: Consolidated Engineering Company, Inc., Kennesaw, Ga.

[21] Appl. No.: 803,413

[22] Filed: Feb. 20, 1997

[51] Int. Cl.[6] ..... B22D 29/00; B02C 19/12

[52] U.S. Cl. ..... 164/5; 164/131; 164/132; 164/404; 266/176

[58] Field of Search ..... 164/5, 132, 131, 164/404; 266/44, 176

[56] References Cited

U.S. PATENT DOCUMENTS

| | | | |
|---|---|---|---|
| 2,385,962 | 10/1945 | Barnett | 34/13 |
| 2,813,318 | 11/1957 | Horth | 22/89 |
| 2,988,351 | 6/1961 | Barnett et al. | 263/40 |
| 3,534,946 | 10/1970 | Westerkampe et al. | 263/28 |
| 3,607,071 | 9/1971 | Staffin et al. | 23/230 |
| 3,676,647 | 7/1972 | Staffin et al. | 235/92 |
| 3,677,404 | 7/1972 | Staffin | 210/67 |

(List continued on next page.)

FOREIGN PATENT DOCUMENTS

| | | | |
|---|---|---|---|
| 1197981 | 12/1985 | Canada | 38/18 |
| 2072874 | 12/1970 | France . | |
| 2307773 | 2/1973 | Germany . | |
| 2315958 | 4/1974 | Germany . | |
| 2337894 | 11/1974 | Germany . | |
| 2914221 | 4/1979 | Germany . | |
| 3206048 | 2/1982 | Germany . | |
| 4012158 | of 1989 | Germany | 164/5 |

(List continued on next page.)

OTHER PUBLICATIONS

Economical Used Energy Type Continuing Heat Treating Furnace For Aluminum Castings–Kogyo–Kanetsu vol. 21 No. 2 pp. 29–36—Published Mar. 1984.

Brochures Describing Beardsley & Pipe PNEU–Reclaim Sand Reclamation Units—Prior to Aug. 13, 1992.

Brochure Describing Fataluminum Sand Reclamation Units—Prior to Aug. 13, 1992.

Paul M. Crafton—Heat Treating Aging System Also Permits Core Sand Removal—Reprinted From Sep. 1989–Modern Casting Magazine.

Preliminary Remarks Dated Jul. 30, 1991 and file in Serial No. 07/705,626.

Declaration by P.M. Crafton & S.P. Crafton Dated Jul. 26, 1991 & Filed in Serial No. 07/705,626.

On Sale Description Re: System of Consolidated Engineering System.

Sales Brochure Describing Thermfire Brand Sand Reclamation, Gudgeon Brothers, Ltd. Believed to be Known by Other Prior to Sep. 1989.

Sales Brochure Describing Simplicity/Richards Gas–Fired Thermal Reclamation System Simplicity Eng. Inc., Believed to be Known by Others Prior to Sept. 1989.

Sales Brochure Describing Air Trac Brand Fluidizing Conveyor, Air Trac System Corp, Believed to be Known by Ohters Prior to Sep. 1989.

Sales Brochure Describing Fluid Bed Calcifer Thermal Sand Reclamation Systems, Dependable Foundry Equip. Co., Believed to be Known by Others Prior to Sep. 1989.

*Primary Examiner*—Kuang Y. Lin

*Attorney, Agent, or Firm*—Isaf, Vaughan & Kerr; Louis T. Isaf

[57] ABSTRACT

Provided is a process/integrated furnace system that (i) receives and heat treats a casting, (ii) removes sand core materials from the casting, and (iii) actively reclaims sand from the sand core materials. The furnace system includes a heating chamber that receives and heat treats metal castings. During the heat treating process, sand core materials are dislodged and fall from the castings into a sand reclaiming region. A hot fluidized bed functions to reclaim sand from the fallen sand core materials within the heating chamber. The fallen sand core materials are not evenly distributed across the zones within the heating chamber. To compensate for the uneven distribution, sand discharge weirs and leveling bars divide the hot fluidized bed in to different bed zones having different dwell times.

20 Claims, 4 Drawing Sheets

U.S. PATENT DOCUMENTS

| | | | |
|---|---|---|---|
| 3,737,280 | 6/1973 | Cromp | 432/14 |
| 3,760,800 | 9/1973 | Staffin et al. | 128/24.1 |
| 3,871,438 | 3/1975 | Vissers et al. | 164/5 |
| 4,068,389 | 1/1978 | Staffin et al. | 34/57 A |
| 4,140,467 | 2/1979 | Ellison et al. | 432/72 |
| 4,161,389 | 7/1979 | Staffin et al. | 432/58 |
| 4,211,274 | 7/1980 | Slowinski et al. | 164/401 |
| 4,242,077 | 12/1980 | Hyre | 431/19 |
| 4,294,436 | 10/1981 | Takahashi | 266/257 |
| 4,340,433 | 7/1982 | Harding | 148/16 |
| 4,392,814 | 7/1983 | Harding | 431/170 |
| 4,411,709 | 10/1983 | Nakanishi | 148/3 |
| 4,415,444 | 11/1983 | Guptail | 209/3 |
| 4,457,352 | 7/1984 | Scheffer | 164/5 |
| 4,457,788 | 7/1984 | Staffin et al. | 148/20.3 |
| 4,478,572 | 10/1984 | Selli | 432/13 |
| 4,512,821 | 4/1985 | Staffin et al. | 148/16.5 |
| 4,519,718 | 5/1985 | Staffin et al. | 374/45 |
| 4,524,957 | 6/1985 | Staffin et al. | 266/252 |
| 4,544,013 | 10/1985 | Kearney et al. | 164/5 |
| 4,547,228 | 10/1985 | Girrell et al. | 148/16 |
| 4,563,151 | 1/1986 | Vogel | 432/15 |
| 4,577,671 | 3/1986 | Stephan | 164/401 |
| 4,579,319 | 4/1986 | Sasaki | 266/252 |
| 4,582,301 | 4/1986 | Wünning | 266/87 |
| 4,604,055 | 8/1986 | Mackenzie | 432/58 |
| 4,613,713 | 9/1986 | Staffin et al. | 585/241 |
| 4,620,586 | 11/1986 | Musschoot | 164/253 |
| 4,623,400 | 11/1986 | Japka et al. | 148/6.35 |
| 4,648,836 | 3/1987 | Thom | 432/107 |
| 4,671,496 | 6/1987 | Girrell et al. | 266/78 |
| 4,700,766 | 10/1987 | Godderidge | 164/5 |
| 4,779,163 | 10/1988 | Bickford et al. | 361/212 |
| 4,830,605 | 5/1989 | Hodate et al. | 431/170 |
| 4,955,425 | 9/1990 | McKenna | 164/269 |
| 4,957,431 | 9/1990 | Eng et al. | 432/31 |
| 5,018,707 | 5/1991 | Hemsath et al. | 266/254 |
| 5,169,913 | 12/1992 | Staffin et al. | 526/65 |
| 5,253,698 | 10/1993 | Keough et al. | 164/269 |
| 5,294,094 | 3/1994 | Crafton et al. | 266/44 |
| 5,350,160 | 9/1994 | Crafton et al. | 266/252 |
| 5,354,038 | 10/1994 | Crafton | 266/44 |
| 5,378,434 | 1/1995 | Staffin et al. | 422/141 |
| 5,423,370 | 6/1995 | Bonnemasou et al. | 164/132 |
| 5,439,045 | 8/1995 | Crafton | 164/5 |
| 5,531,423 | 7/1996 | Crafton et al. | 266/44 |
| 5,565,046 | 10/1996 | Crafton et al. | 148/538 |

FOREIGN PATENT DOCUMENTS

| | | | |
|---|---|---|---|
| 5653867 | 5/1981 | Japan . | |
| 5939464 | 8/1982 | Japan . | |
| 5825860 | 2/1983 | Japan . | |
| 59-219410 | 12/1984 | Japan . | |
| 6092040 | 5/1985 | Japan | 164/132 |
| 2074022 | 9/1985 | Japan . | |
| 63-16853 | 1/1988 | Japan | 164/132 |
| 1129012 | 7/1982 | U.S.S.R. . | |
| 0234810 | 3/1985 | U.S.S.R. | 164/132 |
| 1392405 | 4/1975 | United Kingdom . | |
| 1564151 | 4/1980 | United Kingdom . | |
| 1569152 | 6/1980 | United Kingdom . | |
| 2230720 | 10/1990 | United Kingdom . | |

TERRACED FLUIDIZED BED

CROSS-REFERENCE TO RELATED APPLICATION

This Application claims the benefit of priority to U.S. Provisional patent application Ser. No. 60/012,308, filed on Feb. 23, 1996.

BACKGROUND OF THE INVENTION

The present invention relates generally to the field of foundry processing, and more particularly to heat treating metal castings and reclaiming sand from sand cores and sand molds used in the manufacture of metal castings.

Many improvements have been made in the field of heat treating metal castings and reclaiming sand from sand cores and sand molds used in the manufacture of metal castings. Examples of some recent improvements are disclosed in U.S. Pat. Nos. 5,294,094 and 5,354,038, both of which are expressly incorporated herein by reference, in their entirety. Those patents disclose a unique three in one process/integrated system that (i) receives and heat treats a casting, (ii) removes sand core/sand mold materials from the casting, and (iii) very effectively reclaims sand from the sand core/sand mold materials removed from the casting. The sand core/sand mold materials (referred to hereafter as sand core materials) comprise sand that is held together by a binder material such as, but not limited to, a combustible organic resin binder.

Improvements such as those disclosed in the above-mentioned patents are driven, for example, by competition; increasing costs of raw materials, energy, labor, and waste disposal; and environmental regulations. Those factors continue to mandate improvements in the field of heat treating and sand reclamation.

SUMMARY OF THE INVENTION

Briefly described, a preferred embodiment of the present invention comprises a three-in-one process/integrated system that (i) receives and heat treats a casting, (ii) removes sand core materials from the casting, and (iii) actively reclaims sand from the sand core materials in a fluidized bed that is segregated into distinct zones. The distinct zones compensate for the varied manner in which sand core materials fall from castings into the fluidized bed. In accordance with the preferred embodiment, this compensation includes terracing the fluidized bed in a manner that seeks to insure that substantially all of the reclaimed sand has been subjected to generally the same amount of reclaiming and is therefore reclaimed to substantially the same degree. In accordance with one embodiment of the present invention, the process/integrated system does not heat treat the casting, but removes sand and reclaims sand similarly to the preferred embodiment.

In accordance with the preferred embodiment of the present invention, a furnace system is provided that has a heating chamber. The heating chamber receives and heat treats metal castings. During the heat treating process, sand core materials are dislodged and fall from the castings into a fluidized bed, which is disposed in the lower portion of the heating chamber. The sand core materials fall from castings as the castings pass sequentially through zones of the heating chamber. The fallen sand core materials are typically not evenly distributed across the zones.

In accordance with the preferred embodiment of the present invention, the fluidized bed is disposed within a trough. Fluidizing assemblies substantially cover the bottom of the trough. A weiring system includes sand discharge weirs that are sequentially arranged along the length of the trough. Reclaimed sand is discharged from the trough through each of the sand discharge weirs. The weiring system also includes leveling bars that span the trough. The weiring system accommodates for the uneven distribution of fallen sand core materials and provides control over the reclaiming of sand. The weiring system seeks to expose all portions of sand core material to generally the same amount of reclaiming within the fluidized bed by controlling dwell times and flattening top surfaces of the fluidized bed.

The weiring system segregates the fluidized bed into bed zones. Bed zones into which greater amounts of sand core material are expected to fall (the "higher volume zones") define greater volumes and have greater dwell times, while bed zones into which lesser amounts of sand core material are expected to fall (the "lower volume zones") define lesser volumes and have lesser dwell times. In accordance with the preferred embodiment of the present invention, it is the variations in dwell time that compensate for the varied distribution of fallen sand core portions.

In accordance with the preferred embodiment of the present invention, variations in volume and dwell time are achieved by the fact that different bed zones define different heights. The sand discharge weirs cooperate with the leveling bars to define the different heights. Higher sand discharge weirs are employed where greater amounts of sand core materials are expected to fall into the fluidized bed and lower sand discharge weirs are employed where lesser amounts of sand core materials are expected to fall into the fluidized bed. The leveling bars span the trough such that a leveling bar is disposed between adjacent sand discharge weirs. The upper edges of the leveling bars are higher in areas of higher volume zones and lower in lower volume zones.

It is, therefore, an object of the present invention to increase the efficiency of heat treating and sand reclamation processes.

Yet another object of the present of the present invention is to provide an improved method and apparatus for removing sand core material from a casting and reclaiming sand from the sand core material.

Still another object of the present invention is to provide a single system that provides for substantially complete sand reclamation.

Still another object of the present invention is to provide control over the characteristics of reclaimed sand.

Still another object of the present invention is to compensate for the uneven distribution of sand core materials within a fluidized bed.

Other objects, features, and advantages of the present invention will become apparent upon reading and understanding this specification, when taken in conjunction with the accompanying drawings.

DETAILED DESCRIPTION OF THE PREFERRED EMBODIMENTS

Figure 1:
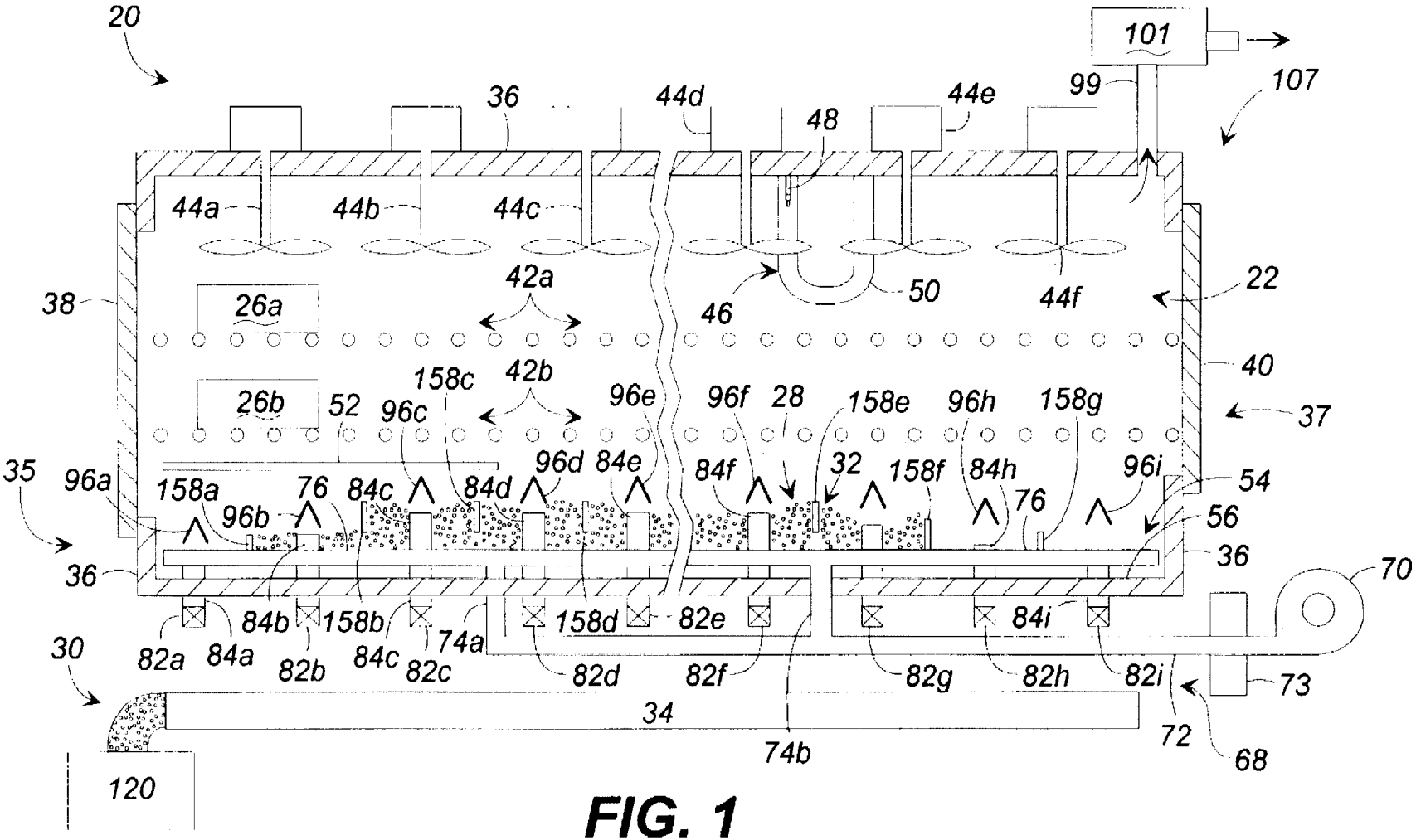
FIG. 1 is a schematic, side cut-away view of a furnace system in accordance with a preferred embodiment of the present invention.

Referring to the drawings in which like numerals represent like components throughout the several views, FIG. 1 is a schematic, side cutaway view of a furnace system 20 in accordance with a preferred embodiment. The furnace system 20 includes a heating chamber 22 that receives and heat treats castings (that are acceptably transported through the heating chamber 22 in baskets 26*a,b*), dislodges sand core materials 28 from the castings, and actively reclaims sand 30 from the sand core materials 28. The reclaiming is carried out, at least in part, in a hot fluidized bed 32 that is preferably disposed within the heating chamber 22. The furnace system 20 includes a plurality of sand discharge weirs 84*a–i* through which reclaimed sand exits the fluidized bed 32 and the heated chamber 22. In FIG. 1, portions of the sand discharge weirs 84*a–i* are hidden from view behind a sub-header assembly 76 portion of a fluidizing assembly 68 that creates the fluidized bed 32. The weirs 84 cooperate with a plurality of leveling bars 158*a–g* to terrace the fluidized bed 32 so that it defines distinct zones that compensate for the varied manner in which sand core materials 28 fall from castings into the fluidized bed 32.

As depicted in FIG. 1, the outlet ends of the weirs 84*a–i* are equipped with valves 82*a–i* which are normally open so that reclaimed sand 30 flows from the fluidized bed 32, through the weirs 84, to a and conveying assembly 34. The sand 30 exits the heating chamber 22 as it passes through the weirs 84. The sand 30 falls from the weirs 84 to the sand conveying assembly 34. The sand conveying assembly 34 is acceptably in the form of one or more vibratory conveyers that transport the reclaimed sand 30 to a hopper 120. The sand in the hopper 120 is substantially ready for reuse.

A front 35 and a rear 37 are defined. The heating chamber 22 includes insulated walls 36, an insulated inlet door 38 toward the front 35, and an insulated outlet door 40 toward the rear 37. In FIG. 1, only the walls 36 and doors 38,40 have been partially cut-away/cross-sectioned. The walls 36 and doors 38,40 bound and define the heated work chamber 22. An upper conveyer assembly 42*a* (e.g., a roller hearth) and a lower conveyer assembly 42*b* (e.g., a roller hearth) extend through the heating chamber 22 from the inlet door 38 to the outlet door 40. The conveyer assemblies 42 each receive and transport the castings (which are preferably disposed within baskets 26) through the heating chamber 22 in a direction defined from the inlet door 38 toward the outlet door 40. A casting quench facility (not shown) is preferably proximate to the outlet door 40 such that castings can be immediately quenched upon removal from the heating chamber 22. The baskets 26 are of open construction to permit sand core materials 28 dislodged from the castings to fall freely out of the baskets 26. Similarly, the conveyer assemblies 42 are constructed so that dislodged sand core materials 28 pass through the conveyer assemblies 42.

The heating chamber 22 can be characterized as including multiple zones through which the baskets 26 pass sequentially. For example, in FIG. 1 a different zone extends with and beneath each of the fans 44*a–f*. While only six fans 44 are shown in FIG. 1, heating chambers 22 with more or less than six fans 44 or zones are within the scope of this disclosure. The fans 44 function to circulate the atmosphere within the heating chamber 22. Heaters 46 heat the atmosphere in the heating chamber 22 to a processing temperature, in the preferred embodiment, sufficient to both heat treat castings and to combust (and pyrolize in regions of castings lacking oxygen) binder that binds the sand of the core material 28, whereby core materials 28 fall from the castings. Preferably a plurality of heaters 46 are employed within the heating chamber 22. A single heater 46 is schematically illustrated in FIG. 1 as including a burner 48 within a U-shaped tube 50. The U-shaped tube 50 isolates the burner 48 from the atmosphere within the heating chamber 22. Alternatively, the burner 48 is exposed to the atmosphere within the heating chamber 22. A variety of different types of heaters 46 can acceptably be employed within the heating chamber 22.

The heaters 46 are capable of heating the atmosphere within the heating chamber 22 to a temperature sufficient to both heat treat the castings and dislodge sand core materials 28 from cavities within the castings. The sand core materials 28 preferably comprise sand that is bound by a combustible binder material such as, but not limited to, an organic resin binder. Thus, the heaters 46 heat the heating chamber 22 to above the combustion temperature of the organic resin binder. The heating chamber 22 is preferably heated to a temperature of approximately 850 to 1000 degrees Fahrenheit. The fans 44*a–f* are preferably constructed to circulate the atmosphere in a manner that aids in the dislodging of core materials 28 from the castings subsequent to binder combustion.

A plurality of screens 52, such as but not limited to one-quarter inch screens, are positioned beneath the conveyer assembly 42*b* in at least some of the earlier zones of the heating chamber 22. The screens 52 extend above the trough 54 (discussed below) in a manner such that the screens 52 capture substantially all of the clumps of sand core material 28 larger than one-quarter inch which are dislodged from the castings. The clumps of core material 28 collected on the screens 52 will continue to be suspended within and exposed to the heated and oxygen-rich airflow within the heating chamber 22 until a substantial portion of the binder associated with the clumps has burned off, at which time the clumps will disintegrate. When the clumps have disintegrated to a size smaller than one-quarter inch, the disintegrated clumps fall through the screens 52. The screens 52 are preferably situated in the earlier and middle zones because that is where a majority of the core materials 28 are expected to be dislodged and fall from the castings. In accordance with certain embodiments, the screens 52 extend for the entire length of the heating chamber 22.

Figure 2:
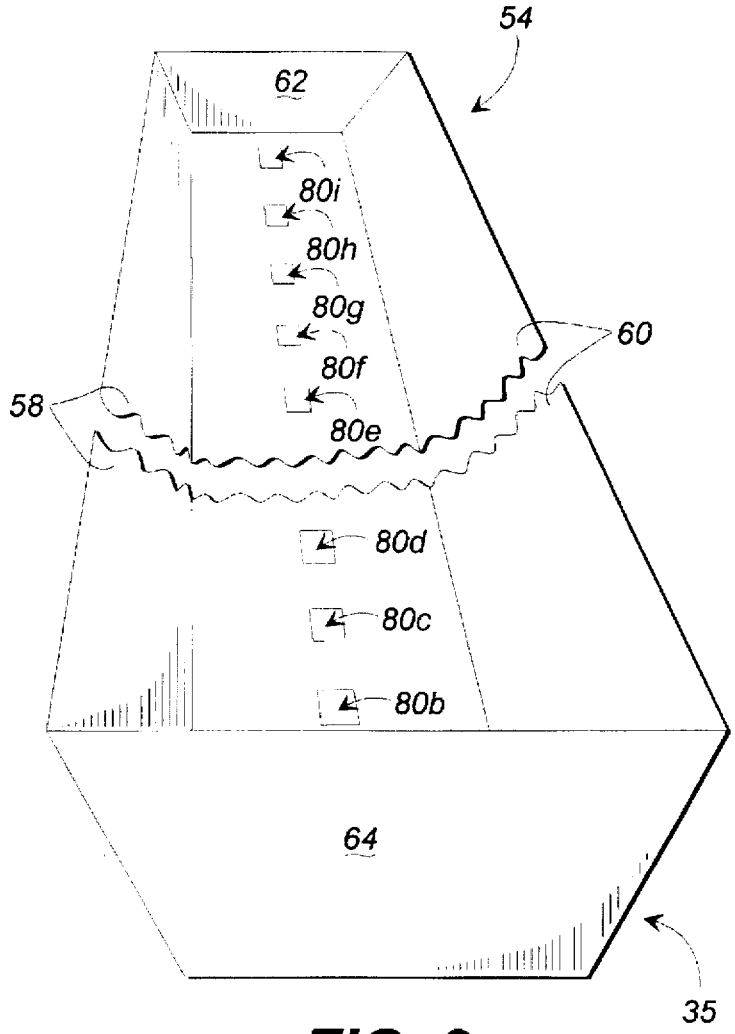
FIG. 2 is an isolated, schematic, perspective view of a collection trough of the furnace system of FIG. 1.

A receptacle such as, but not limited to, a trough 54 is defined in the bottom of the heating chamber 22. FIG. 2 is a isolated perspective view of the trough 54 from the front 35. The trough 54 includes a bottom 56 and side walls 58,60 extending upward from side edges of the bottom 56 in a divergent manner such that obtuse angles are defined between the side walls 58,60 and the bottom 56. Walls 62,64 extend upward from the other edges of the bottom 56. The bottom 56 of the trough 54 defines openings 80*a–i* therethrough (opening 80*a* is not seen in FIG. 2). The sand discharge weirs 84*a–i* (FIG. 1) extend through the openings 80*a–i*, respectively.

Referring to FIG. 1, the fluidizing assembly 68 is closely associated with the bottom 56 of the trough 54. The fluidizing assembly 68 includes a blower 70 that forces a fluidizing medium through a conduit 72 that separates into headers 74*a,b* that feed a sub-header assembly 76. In accordance with the preferred embodiments, the sub-header assembly 76 includes a multiplicity of fluidizing tubes (i.e., the sub-header assembly 76 is preferably a sparger or perforated pipe distributor). A variety of conventional sub-header assemblies 76 are capable of being acceptably incorporated into the disclosed embodiments. In accordance with an alternate embodiment, a sub-header assembly 76 is not employed and the bottom 56 of the trough 54 functions as part of the fluidizing assembly 68. That is, the bottom 56 is perforated and a fluidizing medium is forced through the perforations of the bottom 56.

In accordance with the preferred embodiment, the conduit 72 cooperates with a heater assembly 73 that heats the fluidizing medium to a temperature in excess of the combustion temperature of the binder of the core material 28. The heating of the fluidizing medium above the combustion temperature of the binder of the core material 28 causes binder to combust within the hot fluidized bed 32. In the preferred embodiment, the heater assembly 73 includes a high pressure gas burner (not shown) that is preferably operated such that the burner does not consume all of the oxygen passing through the heater assembly 73, as discussed in greater detail below. In accordance with alternate embodiments, the heater assembly 73 incorporates an electric heating element or other type of heater. In accordance with other alternate embodiments, a heater assembly 73 is not employed. In that alternate embodiment, the heating chamber 22 is sufficiently heated such that binder materials combust within the fluidized bed 32. The heating chamber 22 controllably vents to the atmosphere through an exhaust conduit 99 that communicates with an incinerator 101.

Figure 3:
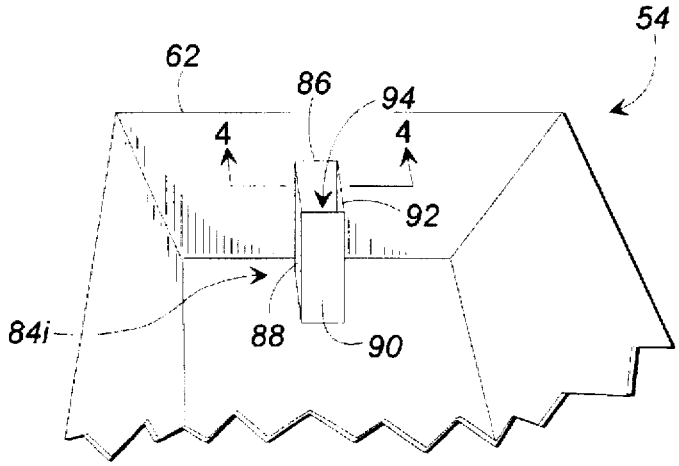
FIG. 3 is a perspective, schematic, cut-away view of the collection trough and a weir of the furnace system of FIG. 1.

FIG. 3 is a schematic, cut-away, perspective view of a portion of the trough 54 and the sand discharge weir 84*i* from the front 35 (FIG. 1). The weir 84*i* fits over or through the opening 80*i* (FIG. 2) such that the opening 80*i* is hidden from view in FIG. 3. Except for the fact that the weirs 84*a–i* (FIG. 1) define different heights, weir 84*i* is representative of the weirs 84*a–h*. That is, in accordance with the preferred embodiment, each of the discharge weirs 84*a–i* is identical, except for variations in height, as discussed below. The weir 84*i* extends upward from the opening 80*i* (FIG. 2) and includes walls 86, 88, 90, 92 that are joined at their edges such that the weir 84*i* is in the form of an elongated conduit that is generally in the shape of a square in a top plan view thereof. The walls 86, 88, 90, 92 bound a passage 94 that is open at the upper end of the weir 84 within the trough 54. At the lower end of the weir 84*i*, the passage 94 is open to discharge reclaimed sand 30 (FIG. 1) to the conveyor assembly 34 (FIG. 1) when the valve 82*i* is open.

Figure 4:
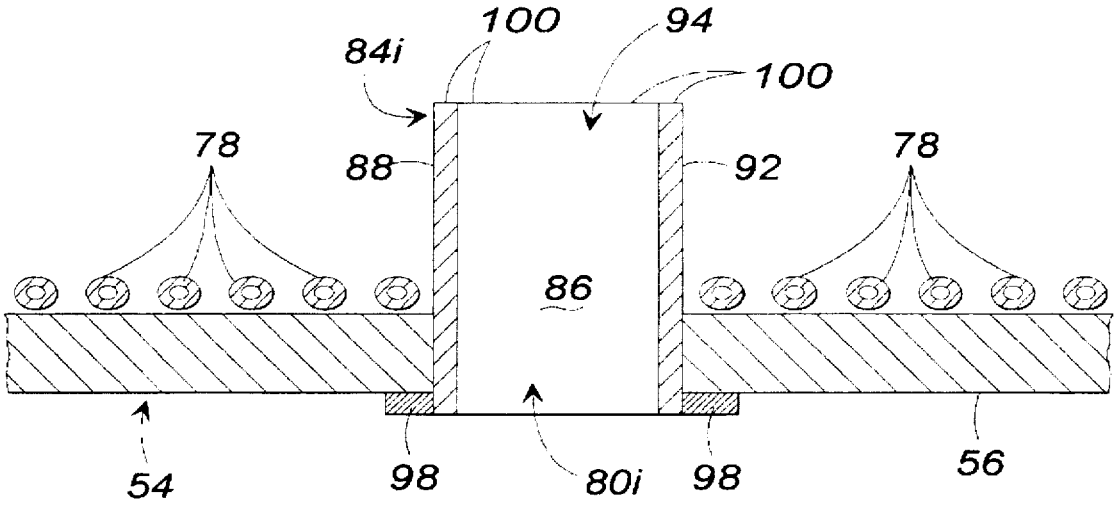
FIG. 4 is a schematic, cut-away, cross-sectional view of a portion of the furnace system of FIG. 1 taken along line 4—4 of FIG. 3. Substantial portions of the furnace system have been cut-away, and cross-sectioned fluidizing tubes are shown in FIG. 4.

FIG. 4 is a schematic, cut-away, cross-sectional view of the furnace system 20 (FIG. 1), taken along line 4—4 of FIG. 3. The valve 82*i* is not shown and substantial portions of the furnace system 20, including portions of the trough 54 and sub-header 76, are cut away in FIG. 4. Additionally, in FIG. 4, the sub-headers 76 are depicted in the form of fluidizing tubes 78, only several of which are specifically identified in FIG. 4. The fluidizing tubes 78 are cross-sectioned transverse to their length in FIG. 4. The fluidizing tubes 78 preferably define a plurality of apertures (not shown) through the sidewalls thereof. The fluidizing medium passes through the apertures in the side walls of the fluidizing tubes 78. The apertures are preferably oriented downward in a manner that seeks to keep sand 30 and sand core materials 28 from entering the fluidizing tubes 78.

The walls 86,88,90,92 (also see FIG. 3) of the weir 84*i* preferably each extend to the same height above the bottom 56 of the trough 54. Therefore, the upper edges of the walls 86,88,90,92 together function as a weir edge 100 over which the sand 30 (FIG. 1) flows into the passage 94 to pass through the weir 84*i*. The weir edge 100 and the opening defined by the weir edge 100 preferably define a generally horizontal plane. As seen in FIG. 4, the lower edges of the walls 86,88,90,92 (also see FIG. 3) of the weir 84*i* preferably extend through the bottom 56 of the trough 54. A flange 98 preferably bounds the opening 80*i* and is attached to the bottom of the trough 54, for example by welding. The lower edges of the weir 84*i* are preferably attached to the flange 98, for example by welding.

As depicted in FIG. 1, inverted V-shaped baffles 96*a–i* are positioned above the upper opening to the passage 94 (FIG. 4) of each weir 84*a–i*, respectively. The baffles 96 do not interfere with the flow of sand 30 from the hot fluidized bed 32 into the passages 94 of the weirs 84. The baffles 96 are broad enough to substantially keep any sand core materials 28 from falling directly into the weirs 84 from above the hot fluidized bed 32. That is, the baffles 96 deflect sand core materials 28 such that the sand core materials fall into the hot fluidized bed 32.

Referring to FIG. 1, the valves 82*a–i* function to open and close the passages 94 (FIGS. 3 and 4) defined through the weirs 80*a–i*, respectively. The valves 82*a–i* are represented schematically in FIG. 1. The valves 82*a–i* are open during normal operation. The valves 82*a–i* may be closed in the case of an emergency. The valves 82*a–i* are preferably manual gate or dump valves, or vibratory feeder valves, or stone-box type valves.

Figure 6:
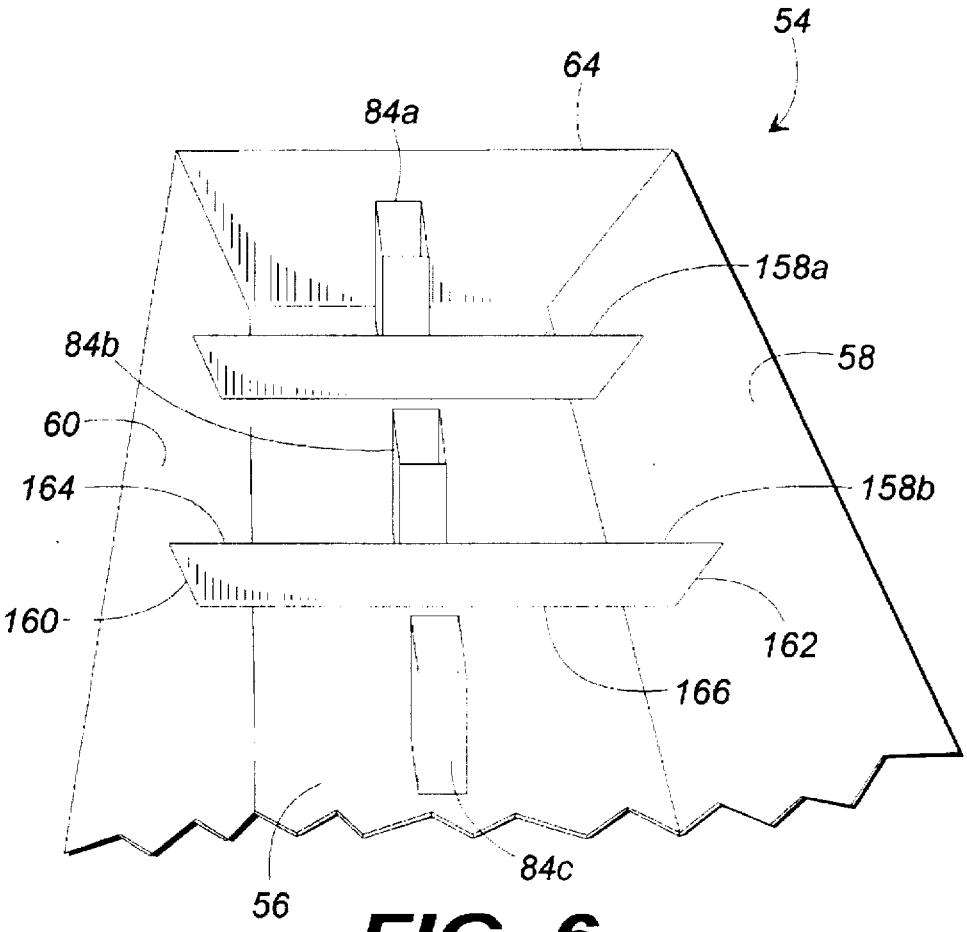
FIG. 6 is a schematic, cut-away, perspective view of portions of the collection trough and a few of the sand discharge weirs and leveling bars of FIG. 1.
Figure 5:
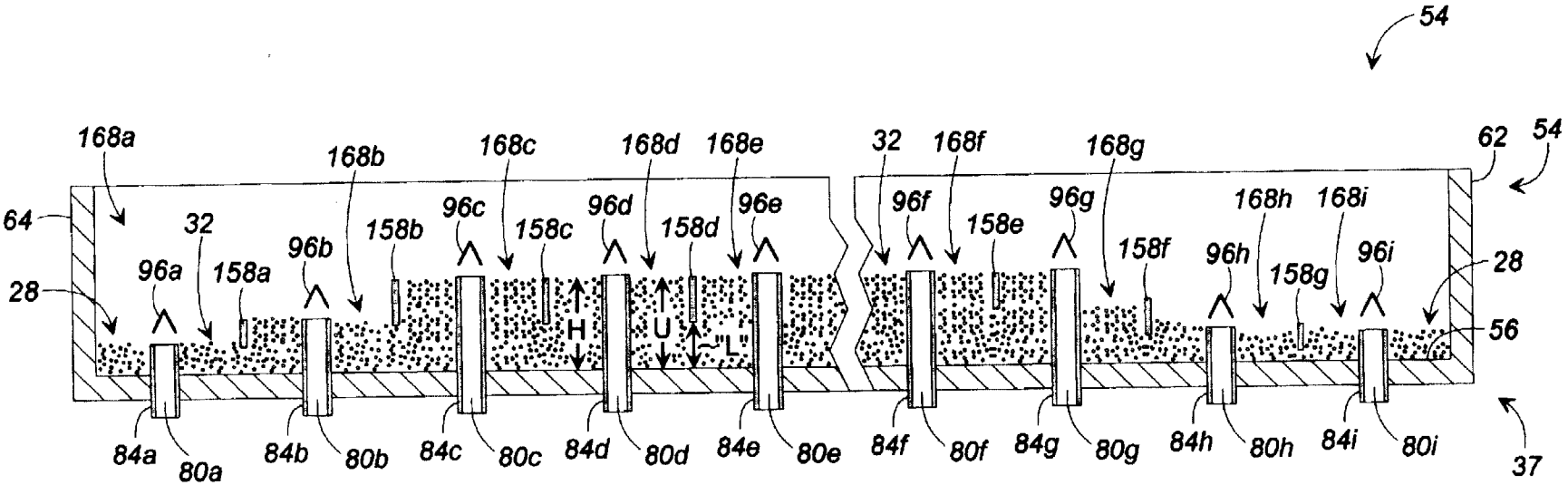
FIG. 5 is an isolated, schematic, side cut-away view of the collection trough, sand discharge weirs, leveling bars, and fluidized bed of FIG. 1.

FIG. 5 is a, schematic, side cut-away view of the trough 54 fitted with the sand discharge weirs 84*a–i*, the leveling bars 158*a–g* (e.g., partitions), the inverted V-shaped baffles 96*a–i*, and containing the fluidized bed 32, in accordance with the preferred embodiment of the present invention. The sub-header assembly 76 is not depicted in FIG. 5 in an effort to clarify the view. FIG. 6 is a, schematic, perspective, partially cut-away view from the rear 37 (FIG. 1) of the trough 54 fitted with a few of the sand discharge weirs 84 and leveling bars 158, in accordance with the preferred embodiment.

Referring primarily to FIG. 6 and leveling bar 158*b* for example, in accordance with the preferred embodiment, each leveling bar 158 is an elongated generally flat slab having opposite ends 160, 162 that are connected to the opposite side walls 58,60 of the trough 54. Each leveling bar extends generally perpendicular to the length of the trough 54. Additionally, each leveling bar 158 includes an upper edge 164 and a lower edge 166 that extend generally horizontally and are disposed above the bottom 56 of the trough 54.

Referring to FIG. 5, certain of the weirs 84 define different weir heights. The weir height of each weir 84 is defined as the distance between the respective weir edge 100 (FIG. 4) and the bottom 56 of the trough 54. As an example, the dimension "H" identified with respect to the weir 84*d* represents the weir height of the weir 84*d*. Similarly, the upper edge 164 (FIG. 6) and lower edge 166 (FIG. 6) of each leveling bar 158 define an upper height and a lower height, respectively, above the bottom 56 of the trough. As an example, the dimension "U" identified with respect to the leveling bar 158*d* represents the upper height of the leveling bar 158*d*. Similarly, the dimension "L" identified with respect to the leveling bar 158*d* represents the lower height of the leveling bar 158*d*.

In accordance with the preferred embodiment, a leveling bar 158 is disposed between two adjacent weirs 84, and the upper and lower heights of the leveling bars 158 are coordinated with the weir heights of the adjacent weirs 84. Where adjacent weirs 84 define different weir heights, the upper height of the leveling bar 158 interposed between the adjacent weirs 84 is generally equal to the highest weir height of the adjacent weirs 84. Similarly, the lower height of that leveling bar 158 is generally equal to the lowest weir height of the adjacent weirs 84. Where adjacent weirs 84 define generally the same weir heights, the upper height of the leveling bar 158 interposed between the adjacent weirs 84 is generally equal to the weir heights of the adjacent weirs 84. The lower heights of all of the leveling bars 158 are preferably high enough to allow the fluidized bed 32 to readily flow beneath the leveling bars 158.

The leveling bars 158 function to restrict flow of the fluidized bed 32 proximate to the upper surface of the fluidized bed 32. The upper heights of the leveling bars 158 function to separate the upper surface of the fluidized bed 32 into bed zones 168*a–i*. A first bed zone 168*a* is defined between the leveling bar 158*a* and the wall 64 of the trough 54, a second bed zone 168*b* is defined between the leveling bar 158*a* and the leveling bar 158*b*, a third bed zone 168*c* is defined between the leveling bar 158*b* and the leveling bar 158*c*, a fourth bed zone 168*d* is defined between the leveling bar 158*c* and the leveling bar 158*d*, a fifth bed zone 168*e* is defined between the leveling bar 158*d* and a leveling bar that is not shown in FIG. 6, a sixth bed zone 168*f* is defined between the leveling bar that is not shown in FIG. 6 and the leveling bar 158*e*, a seventh bed zone 168*g* is defined between the leveling bar 158*e* and the leveling bar 158*f*, an eighth bed zone 168*h* is defined between the leveling bar 158*f* and the leveling bar 158*g*, and a ninth bed zone 168*i* is defined between the leveling bar 158*g* and the wall 62 of the trough 54. In accordance with the preferred embodiment, the amount of the sub header assembly 76 (FIG. 1 ) disposed within each of the bed zones 168 is generally equivalent, whereby in theory each bed zone 168 receives generally the same amount of fluidizing medium. Reclaimed sand 30 (FIG. 1) exits the bed zones 168*a–i* through the sand discharge weirs 84*a–i*, respectively.

The leveling bars 158 and the sand discharge weirs 84 cooperate such that the fluidized bed 32 has a generally planar and generally horizontally extending upper surface in each bed zone 168*a–i*. The surface height of the fluidized bed 32 above the bottom 56 of the trough 54 is preferably different in different bed zones 168. The height of the surface of the fluidized bed 32 in a particular bed zone 168 corresponds generally to the weir height of the weir 84 that is central to that bed zone. Therefore, the hot fluidized bed 32 is terraced. In accordance with one acceptable example, the weir 84*a* and the portion of the hot fluidized bed 32 around the weir 84*a* (i.e., the portion of the hot fluidized bed 32 in the first bed zone 168*a*) define a height of approximately one hundred and fifty millimeters; the weir 84*b* and the portion of the hot fluidized bed 32 around the weir 84*b* (i.e., the portion of the hot fluidized bed 32 in the second bed zone 168*b*) define a height of approximately two hundred millimeters; and the weir 84*c* and the portion of the hot fluidized bed 32 around the weir 84*c* (i.e., the portion of the hot fluidized bed 32 in the third bed zone 168*c*) define a height of approximately three hundred millimeters.

In accordance with the preferred embodiment, the volume of an individual bed zone 168 (which correlates to the quantity of sand core materials 28 within that individual bed zone) is proportional to the height of the fluidized bed 32 within that individual bed zone 168. The height of the fluidized bed 32 within an individual bed zone 168 corresponds generally to the weir height of the weir 84 within that individual bed zone. In accordance with the preferred embodiment, each bed zone 168*a–i* is similar in construction such that, if each bed zone 168*a–i* contained the same height of sand core materials 28 therein (which is not the case in accordance with the preferred embodiment), each bed zone 168*a–i* would contain the same quantity or volume of sand core materials 28.

Operation

Referring to FIG. 1, in accordance with the preferred embodiment, the furnace system 20 (i) receives and heat treats castings, (ii) removes sand core materials 28 from the castings, and (iii) actively reclaims sand 30 from the sand core materials 28. Initially, metal castings such as, but not limited to, aluminum castings are placed into baskets 26. The castings preferably have at least some sand core materials 28 attached thereto. The sand core materials 28 preferably comprise sand bound by a binder material such as, but not limited to, a combustible organic resin binder. Most preferably the castings are aluminum castings that define cavities and have substantially intact sand cores (comprising sand bound by a combustible binder) therein. In accordance with an alternate embodiment, sand core materials 28 are introduced into the heating chamber 22 separate from the castings.

The inlet door 38 is temporarily opened and a basket 26 is placed upon one of the conveyer assemblies 42. Alternatively the castings may be placed directly upon the conveyer assemblies 42. As the castings are conveyed through the heating chamber 22 at least a portion of the binder of the sand cores combusts (or, in appropriate condition, pyrolize) such that sand core materials 28 fall from the castings and the conveyer assemblies 42. The castings are preferably maintained within the heating chamber 22 for a sufficient period such that the castings are heat treated for at least several hours and the sand cores are substantially totally removed from the castings. Oxygen is introduced into the heating chamber 22 to enhance the combustion. Oxygen is preferably supplied with the fluidizing medium (i.e. air) into the bottom of the heating chamber 22 by way of the fluidizing assembly 68. Oxygen (e.g., air) can also be introduced by other means such as by exposing the burner 48 to the atmosphere within the heating chamber 22 and by providing an excess amount of oxygen (e.g., air) to the burner 48. The screens 52 are preferably quarter inch screens so that any lumps of core material 28 larger than a quarter inch are suspended upon the screens 52. While lumps of sand core materials 28 are suspended on the screens 52, further binder combustion occurs such that the lumps disintegrate and fall from the screens 52 into the hot fluidized bed 32.

The sand core materials 28 that fall into the hot fluidized bed 32 are suspended and agitated within the heated and oxygenated environment of the hot fluidized bed 32 such that the binder material associated with the sand core materials 28 is combusted and sand 30 is reclaimed that is substantially ready for reuse. Stated differently, in accordance with the preferred embodiment, calcination occurs within the hot fluidized bed 32 (i.e., the binder material is decomposed). In addition to being heated by the heater assembly 73, the hot fluidized bed 32 is heated due to its proximity to the heater 46 and the heated environment within the heating chamber 22.

In accordance with the preferred embodiment, the reclaimed sand 30 within the hot fluidized bed 32 flows toward the sand discharge weirs 84*a–i* due to the action of the fluidizing assembly 68 and the fact that weirs 84*a–i* are an outlet from the heating chamber 22. During normal operation the valves 82*a–i* are open and the reclaimed sand flows through the weirs 84 and falls onto the sand conveyor 34. The valves 82*a–i* may be closed automatically if such closure would aid in minimizing the negative impacts of certain types of equipment malfunctions. Similarly, the valves 82*a–i* may be operated for maintenance purposes.

In accordance with the preferred embodiments, as castings are transported thought the heating chamber 22, sand core materials 28 fall from the castings in varying amounts. The amount of sand core material 28 that falls from the casting is generally a function of the amount of time that a castings has been disposed within the heating chamber 22. For example, it takes some time for the castings and sand core materials 28 attached to the casting to reach the combustion temperature of the binder that binds the sand core materials 28. Because the castings are preferably transported through the heating chamber 28, the amount of sand core material 28 that falls from the castings is generally a function of the position of the castings along the length of the heating chamber 22.

Based on experience and in accordance with the preferred embodiment, greater amounts of sand core materials 28 are dislodged from castings toward the middle of the heating chamber 22 and lesser amounts of sand core materials 28 are dislodged toward the front 35 and rear 37 ends of the heating chamber 22. Stated differently, in accordance with one exemplary embodiment, the distribution of fallen sand core materials 28 can be represented by a graph or geometric picture generally in the form of a bell-shaped curve. The present invention compensates for the above-described varied distribution of sand core materials 28 to provide a system and process that insures that substantially all of the reclaimed sand 30 has been subjected to generally the same amount of reclaiming and therefore is reclaimed to substantially the same degree.

Referring to FIG. 5, the different heights of the weirs 84*a–i* and the leveling bars 158*a–g* compensate for the variation in the amounts of sand core materials 28 that fall into the fluidized bed 32. The weirs 84*a–i* and the leveling bars 158*a–g* function to generally maintain a level surface of the fluidized bed 32 in individual bed zones 168*a–i*. By maintaining level surfaces of the fluidized bed 32 in individual bed zones 168*a–i*, control is maintained over the reclaiming of sand 30. When a level surface is maintained in an individual bed zone 168, the sand core materials 28 within that individual bed zone 168 tend to experience a generally equivalent amount of exposure to the reclaiming effects of the fluidized bed 32.

The weirs 84*a–i* and the leveling bars 158*a–g* also seek to vary the dwell time of the sand core materials 28 within the fluidized bed 32. The variation of dwell times is established between bed zones 168 and seeks to subject all sand core materials 28 to the same amount of reclaiming irrespective of the bed zone 168 into which the sand core materials 28 fall. This seeks to provide reclaimed sand 30 having uniform properties. That is, in accordance with the preferred embodiment, reclaiming within the bed zones 168 is varied to compensate for varied distribution of fallen sand core materials 28 such that generally all of the reclaimed sand is reclaimed to generally the same degree. In accordance with the preferred embodiment, the bed zones 168 into which greater quantities of sand core materials 28 fall (e.g., bed zones 168*c–f*) hold greater quantities of sand core materials 28 than do the bed zones 168 into which lesser quantities of sand core materials 28 fall (e.g., bed zones 168*a–b,g–i*). Stated differently, the bed zones 168 into which greater quantities of sand core materials 28 fall define greater volumes than do the bed zones 168 into which lesser quantities of sand core materials fall. Individual pieces of core material 28 tend to have a greater dwell times in bed zones 168 having greater volumes.

This paragraph presents one example of the preferred embodiment. In accordance with this example, the first bed zone 168*a* defines a height of approximately one hundred and fifty millimeters and the third bed zone 168*c* defines a height of approximately three hundred millimeters. Since the bed zone 168*c* has approximately twice the height of the bed zone 168*a*, the bed zone 168*c* has approximately twice the volume of the bed zone 168*a*. Since the bed zone 168*c* has approximately twice the volume of the bed zone 168*a*, the bed zone 168*c* has approximately twice the dwell time of the bed zone 168*a*. In accordance with the preferred embodiment, approximately the same amount of fluidizing medium is supplied to each bed zone 168, so variations in dwell time compensate for variations in the quantity of sand core material 28 between bed zones 168. For example, statistically and theoretically, the sand core materials 28 disposed within the bed zone 168*a* will be exposed to substantially the same amount of reclaiming. (i.e., have the same dwell time) as the sand core materials 28 disposed within the bed zone 168*c* such that the sand 30 reclaimed in the bed, zone 168*a* will be substantially similar to the sand 30 reclaimed in the bed zone 168*c*.

In accordance with an alternate embodiment, variations in dwell time are not employed in an effort to equalize the reclamation of the sand 30. Rather, equalized reclaiming between bed zones 168 is established by varying the fluidizing action between individual bed zones 168. In accordance with this alternate embodiment, the fluidizing action is more intense in the zones 168 into which greater quantities of sand core material 28 fall, and the fluidizing action is less intense in the zones 168 into which lesser quantities of sand core material 28 fall. Variations in intensity can be accomplished, for example and not limitation, by varying the quantity of fluidizing medium injected into a bed zone 168. Alternately, a combination of variations in dwell time and variations in fluidizing flow (e.g., variations in the flow of fluidizing medium) are employed.

While the embodiments which have been disclosed herein are the preferred forms, other embodiments will suggest themselves to persons skilled in the art in view of this disclosure. Any relationships and dimensions shown on the drawings are given as the preferred relative relationships, but the scope of this disclosure is not to be limited thereby.

I claim:

1. A method for heat treating a casting having sand core material attached thereto and reclaiming sand from the sand core material, the sand core material comprising sand particles bound together by a combustible binder material, and the method comprising steps of:

conveying the casting through a furnace chamber that defines a plurality of zones that are spatially displaced from one another, heating the core materials within the casting whereby, over time portions of the sand core material are loosened and fall from the casting such that the distribution of sand core materials across the plurality of zones is varied; and reclaiming sand from the fallen sand core materials including a step of compensating for the varied distribution of sand core materials by terracing said sand core material in said plurality of zones.

2. The method of claim 1, wherein the heating step comprises the step of heating the plurality of zones to a temperature sufficient to heat treat the casing.

3. The method of claim 1, wherein the reclaiming step includes a step of fluidizing the fallen sand core materials in a fluidized bed disposed beneath the casting and in heat and gaseous communication with the furnace chamber, and wherein the compensating step includes a step of terracing the fluidized bed to compensate for the varied distribution of the fallen sand core materials.

4. The method of claim 1, wherein the reclaiming step and the compensating step are carried out within the furnace chamber.

5. The method of claim 1, wherein the compensating step are carried out in a manner such that substantially of the reclaimed sand has been subjected to substantially the same amount of reclaiming.

6. The method of claim 1, wherein the reclaiming step includes a step of fluidizing the fallen sand core materials in a fluidized bed disposed beneath the casting and in heat and gaseous communication with the furnace chamber, and wherein the compensating step includes steps of retaining a first quantity of sand core materials in a first section of the fluidized bed into which a first amount of the sand core materials fall, and retaining a second quantity of sand core materials in a second section of the fluidized bed into which a second amount of the sand core materials fall, wherein the first quantity is substantially greater than the second quantity and the first amount is substantially greater than the second amount.

7. The method of claim 1, wherein the reclaiming step includes a step of fluidizing the fallen sand core materials in a fluidized bed disposed beneath the casting and in heat and gaseous communication with the heating chamber, and wherein the compensating step includes steps of segregating the fluidized bed into a plurality of sections, and controlling the dwell time of the fallen sand core materials within the sections of the fluidized bed to compensate for the varied distribution of the fallen sand core materials.

8. The method of claim 7, wherein the controlling step includes steps of retaining a first quantity of sand core materials in a first section of the fluidized bed into which a first amount of the sand core materials fall, and retaining a second quantity of sand core materials in a second section of the fluidized bed into which a second amount of the sand core materials fall, wherein the first quantity is substantially greater than the second quantity and the first amount is substantially greater than the second amount.

9. The method of claim 7, wherein the controlling step includes steps of retaining a first height of sand core materials in a first section of the fluidized bed into which a first amount of the sand core materials fall, and retaining a second height of sand core materials in a second section of the fluidized bed into which a second amount of the sand core materials fall, wherein the first height is substantially greater than the second height and the first amount is substantially greater than the second amount.

10. A method for heat treating a casting having a sand core and reclaiming sand from the sand core, the sand core comprising sand particles bound together by a binder material, the sand core defining a cavity within the casting, and the method comprising steps of:

placing the casting with at least some sand core therein upon a support assembly disposed within a furnace that defines a plurality of furnace zones that are spatially displaced from one another;

conveying the casting sequentially through furnace zones of the plurality of furnace zones;

heating the core materials within the casting whereby, over time portions of the sand core material are loosened and fall from the casting such that the distribution of sand core materials across the plurality of zones is varied; and reclaiming, at a reclaiming region distant from the casting and the support assembly, at least some sand from portions of the fallen sand core portions by burning binder material of portions of the fallen sand core portions, wherein the reclaiming region defines a plurality of reclaiming zones that correspond generally to the plurality of furnace zones, and wherein the reclaiming within reclaiming zones of the plurality of reclaiming zones is varied by terracing said sand core material in said reclaiming zone to compensate for varied distribution of fallen sand core materials such that generally all of the reclaimed sand is reclaimed to generally the same degree.

11. The method of claim 10, wherein the heating step comprises the step of heating the plurality of zones to a temperature sufficient to heat treat the casing.

12. The method of claim 10, wherein the reclaiming step includes a step of fluidizing the fallen sand core materials in a fluidized bed disposed beneath the plurality of zones; and wherein the compensating step includes steps of retaining a first quantity of sand core materials in a first section of the fluidized bed into which a first amount of the sand core materials fall, and retaining a second quantity of sand core materials in a second section of the fluidized bed into which a second amount of the sand core materials fall, wherein the first quantity is substantially greater than the second quantity and the first amount is substantially greater than the second amount.

13. The method of claim 10, wherein the reclaiming step includes a step of fluidizing the fallen sand core materials in a fluidized bed, and wherein the compensating step includes a step of terracing the fluidized bed to compensate for the varied distribution of the fallen sand core materials.

14. The method of claim 10, wherein heat and gaseous communication occurs between the reclaiming region and the furnace.

15. The method of claim 10, wherein the reclaiming step includes steps of agitating and exposing the fallen sand core portions to an oxygenated atmosphere in a manner that facilitates additional burning of binder material.

16. The method of claim 15, wherein the reclaiming region is beneath the support assembly such that the released sand core portions fall, under the force of gravity, from the support assembly to the reclaiming region.

17. A furnace system for heat treating a casting having sand core material attached thereto and reclaiming sand from the sand core material, the sand core material comprising sand particles bound together by a binder material, the sand core material defining a cavity within the casting, and the furnace system comprising:

a heating work chamber for receiving the casting therewithin;

heating means for heating said heating work chamber to a temperature sufficient to heat treat the casting and dislodge portions of the sand core material from the casting, whereby portions of the sand core material fall from the casting while the casting is within said heating work chamber;

a receptacle for receiving the fallen portions of the sand core material and in gaseous and heat communication with said heating work chamber, said receptacle including a bottom, and a plurality of walls extending upward from said bottom and cooperating with said bottom to define a cavity disposed above said bottom and partially bounded by said plurality of walls;

a fluidizer for fluidizing the sand core material within said receptacle to reclaim sand; and a plurality of weir conduits in said cavity wherein each weir conduit of said plurality of weir conduits defines an elongated passage and includes a first end including a weir edge that defines an upper weir opening that is open to said passage, wherein sand flows over said weir edge into said passage to exit the receptacle, and wherein said opening is disposed above said bottom to define a weir height, and a second end, wherein said passage is open at said second end and the sand flows from said second end to exit said receptacle, and wherein said weir conduits of said plurality of weir conduits define different weir heights.

18. The furnace system of claim 17, further comprising a plurality of partitions extending between weir conduits of said plurality of weir conduits.

19. The furnace system of claim 18, wherein a partition of said plurality of partitions is disposed above said bottom and extends generally horizontally between walls of said plurality of walls and includes an upper edge and a lower edge disposed beneath said upper edge, wherein said upper edge defines a height that corresponds generally to said weir height of a proximate weir conduit of said plurality of weir conduits and said lower edge defines a height that corresponds generally to said weir height of a proximate weir conduit of said plurality of weir conduits.

20. The furnace system of claim 18, wherein said plurality of weir conduits and said plurality of partitions are operative to terrace the sand core material within said receptacle.

* * * * *